US008561650B1

(12) United States Patent
Wijerama et al.

(10) Patent No.: US 8,561,650 B1
(45) Date of Patent: Oct. 22, 2013

(54) WEAVING APPARATUS

(75) Inventors: Roshan Wijerama, Chester, NJ (US); Azhelle Ashley Wade, Brooklyn, NY (US); Mary Josephine Feliciano, Clifton, NJ (US); Emmanuel Riego Valdez, Jr., Springfield, NJ (US)

(73) Assignee: Horizon Group USA, Inc., Warren, NJ (US)

( * ) Notice: Subject to any disclaimer, the term of this patent is extended or adjusted under 35 U.S.C. 154(b) by 34 days.

(21) Appl. No.: 13/464,169

(22) Filed: May 4, 2012

(51) Int. Cl.
*D03D 29/00* (2006.01)

(52) U.S. Cl.
USPC ..... 139/29; 139/1 R; 139/11; 139/34

(58) Field of Classification Search
None
See application file for complete search history.

(56) References Cited

U.S. PATENT DOCUMENTS

| | | | | | |
|---|---|---|---|---|---|
| 254,258 | A | * | 2/1882 | Barbour | 28/149 |
| 709,535 | A | * | 9/1902 | Comstock | 139/34 |
| 758,376 | A | * | 4/1904 | Mees | 28/151 |
| 1,203,781 | A | * | 11/1916 | Ratycia | 28/149 |
| 1,857,067 | A | * | 5/1932 | Seiler | 112/9 |
| 2,043,082 | A | * | 6/1936 | Wallach | 28/151 |
| 2,072,668 | A | * | 3/1937 | Eltgroth | 66/4 |
| 2,123,077 | A | * | 7/1938 | Mayer | 28/151 |
| 2,129,297 | A | * | 9/1938 | Zippel | 28/151 |
| 2,395,981 | A | * | 3/1946 | Walker | 289/17 |
| 2,473,398 | A | * | 6/1949 | Spano | 28/152 |
| 2,601,222 | A | * | 6/1952 | Wehrli | 28/151 |
| D176,548 | S | | 1/1956 | Morse | |
| 3,545,069 | A | * | 12/1970 | Krieger | 29/433 |
| 3,650,010 | A | * | 3/1972 | Powell, Jr. | 29/241 |
| 3,688,357 | A | * | 9/1972 | Nielsen et al. | 289/17 |
| 3,708,862 | A | * | 1/1973 | Powell, Jr. | 29/433 |
| 3,800,372 | A | * | 4/1974 | Daoust | 28/152 |
| D245,587 | S | | 8/1977 | Chaves | |
| 4,045,061 | A | * | 8/1977 | Fierro | 289/16.5 |
| 4,103,944 | A | * | 8/1978 | Alvarado et al. | 289/16.5 |
| D257,257 | S | * | 10/1980 | McArthur | D15/66 |
| 4,289,341 | A | * | 9/1981 | Sumpter | 289/16.5 |
| 4,401,329 | A | | 8/1983 | Pedroia | |
| 4,832,085 | A | * | 5/1989 | Northrup | 139/34 |
| 5,435,048 | A | * | 7/1995 | Walker | 28/149 |
| 6,217,086 | B1 | * | 4/2001 | LeTourneau | 289/18.1 |
| 6,719,013 | B1 | * | 4/2004 | D'Estais | 139/29 |
| 7,147,008 | B2 | * | 12/2006 | Sayler | 139/29 |

(Continued)

FOREIGN PATENT DOCUMENTS

| | | | |
|---|---|---|---|
| CN | 102341012 | A | 2/2012 |
| EP | 2403372 | A2 | 1/2012 |

(Continued)

*Primary Examiner* — Bobby Muromoto, Jr.
(74) *Attorney, Agent, or Firm* — Robert P. Michal; Lucas & Mercanti, L.L.P.

(57) ABSTRACT

Weaving apparatus for use in weaving threads into a woven structure includes a base including a retaining structure, a support portion removably engaging with the retaining structure, and a first insert engaging with the support portion. The first insert includes an upper portion defining a receptacle, and a second insert includes a base having an upper portion and a wall projecting from a lower surface of the upper portion. The second insert is positionable in engagement with the first insert by positioning the wall of the second insert at least partly into the receptacle of the first insert. A weaving platform is operatively positioned between the first and second inserts and around at least part of the wall of the second insert. The weaving platform includes slits around its circumference adapted to secure threads during use of the apparatus for weaving.

20 Claims, 9 Drawing Sheets

(56) References Cited

U.S. PATENT DOCUMENTS

| | | | | |
|---|---|---|---|---|
| D619,150 | S * | 7/2010 | Crorey | D15/78 |
| D626,574 | S | 11/2010 | Crorey | |
| 7,946,631 | B2 * | 5/2011 | Crorey | 289/2 |
| 8,002,316 | B2 * | 8/2011 | Oliveto | 289/1.5 |
| D656,524 | S | 3/2012 | Karowowicz | |
| 8,157,297 | B2 * | 4/2012 | Spilbor et al. | 289/17 |
| 8,172,281 | B2 * | 5/2012 | Crorey | 289/17 |
| 8,215,681 | B2 * | 7/2012 | Stevenson | 289/2 |
| D667,468 | S | 9/2012 | Crorey | |
| 8,316,894 | B2 * | 11/2012 | Schaub | 139/29 |
| D674,190 | S | 1/2013 | Wijerama et al. | |
| D676,880 | S | 2/2013 | Crorey | |
| 8,371,624 | B2 * | 2/2013 | Karwowicz et al. | 289/17 |
| D686,253 | S * | 7/2013 | Wijerama et al. | D15/66 |
| 2004/0069363 | A1 * | 4/2004 | D'Estais | 139/1 R |
| 2011/0259465 | A1 * | 10/2011 | Schaub | 139/29 |

FOREIGN PATENT DOCUMENTS

| | | |
|---|---|---|
| JP | 01-256315 | 12/1989 |
| WO | WO 2006/053909 A1 | 5/2006 |
| WO | WO 2010/101672 A1 | 9/2010 |

* cited by examiner 28
30
26

40
38
38
36

38A
42
42A
74
48
36
40
54
56
48
50
46

58
60

54A
66
62

70
52
72

FIG. 13
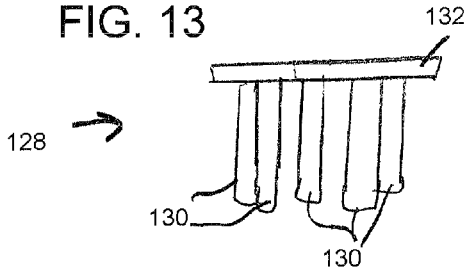
FIG. 14
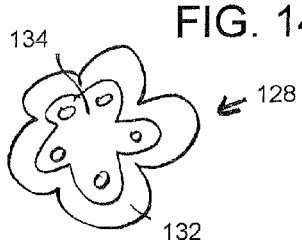
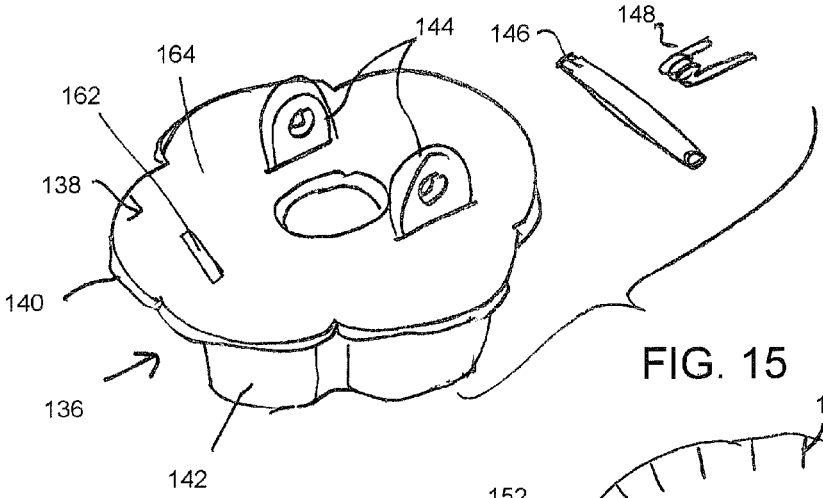
FIG. 15
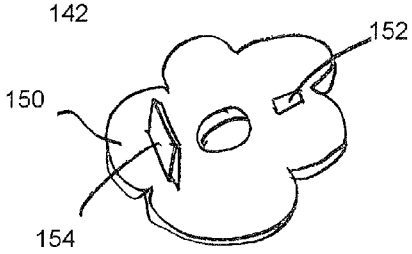
FIG. 16
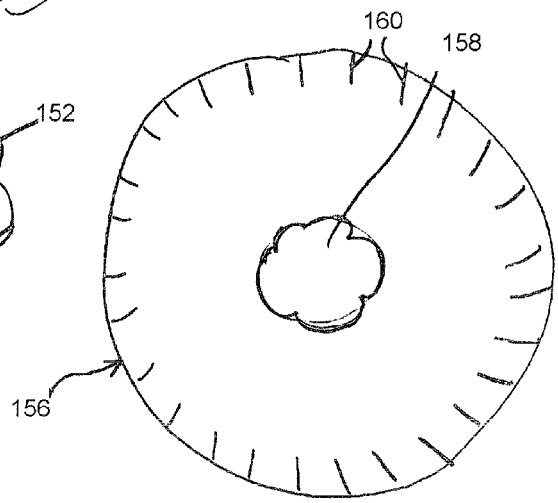
FIG. 17

WEAVING APPARATUS

FIELD OF THE INVENTION

The present invention is directed generally to an apparatus for weaving a plurality of threads together and more specifically, to an apparatus for making a woven structure from a plurality of threads in various designs which is commonly referred to as a friendship bracelet. Even more particularly, embodiments of the weaving apparatus are adapted for travel so that its user can use it while travelling, e.g., in a car or on an airplane, ship or train.

BACKGROUND OF THE INVENTION

Friendship bracelets are a type of costume jewelry woven by hand from usually multi-colored strings in various patterns, with the color of the strings and the weaving pattern being selected by the weaver. The bracelets are often made by children and given to one another as a token of friendship.

SUMMARY OF THE INVENTION

One embodiment of a weaving apparatus for use in weaving threads into a woven structure, such as a friendship bracelet, in accordance with the invention includes a base including retaining structure, a support portion removably engaging with the retaining structure, a first insert that engages with the support portion and defines a receptacle, and a second insert that includes a base having a projecting wall and is positionable in engagement with the first insert by positioning the wall of the second insert at least partly into the receptacle of the first insert. The second insert also includes a holding or securing mechanism that temporarily holds or secures threads to be woven using the apparatus, which mechanism is used during use of the apparatus for weaving. A weaving platform is positionable between the first and second inserts and around at least part of the wall of the second insert, and includes slits around its circumference adapted to secure threads.

Another embodiment of a weaving apparatus for use in weaving threads into a woven structure, such as a friendship bracelet, in accordance with the invention includes a frame including a base, a cover movable relative to the base to provide the frame with a closed configuration and an open configuration, and a support portion. The apparatus also includes a first insert that engages with the support portion and includes an upper portion defining a receptacle, and a second insert including a base having an upper portion and a wall projecting from a lower surface of the upper portion. The second insert is positionable in engagement with the first insert by positioning the wall of the second insert into the receptacle of the first insert. The second insert also includes a securing mechanism that secures threads to be woven using the apparatus, which mechanism is used during use of the apparatus for weaving. The apparatus also includes a weaving platform positionable between the first and second inserts and around at least part of the wall of the second insert. The weaving platform includes slits around its circumference adapted to secure threads during use of the apparatus for weaving.

BRIEF DESCRIPTION OF THE DRAWINGS

The invention may best be understood by reference to the following detailed description of and illustrative embodiment when read in conjunction with the accompanying drawings, wherein:

FIG. 13 is a side view of a first insert into the base of the apparatus shown in FIG. 11;

FIG. 14 is a top view of the first insert shown in FIG. 3;

FIG. 15 is an exploded perspective view of part of a second insert that is engaged with the first insert of the apparatus shown in FIG. 11;

FIG. 16 is a bottom view of a flap of the second insert shown in FIG. 15; and FIG. 17 is a top view of a weaving platform that is secured on the base of the apparatus shown in FIG. 11.

DETAILED DESCRIPTION OF THE INVENTION

Figure 1:
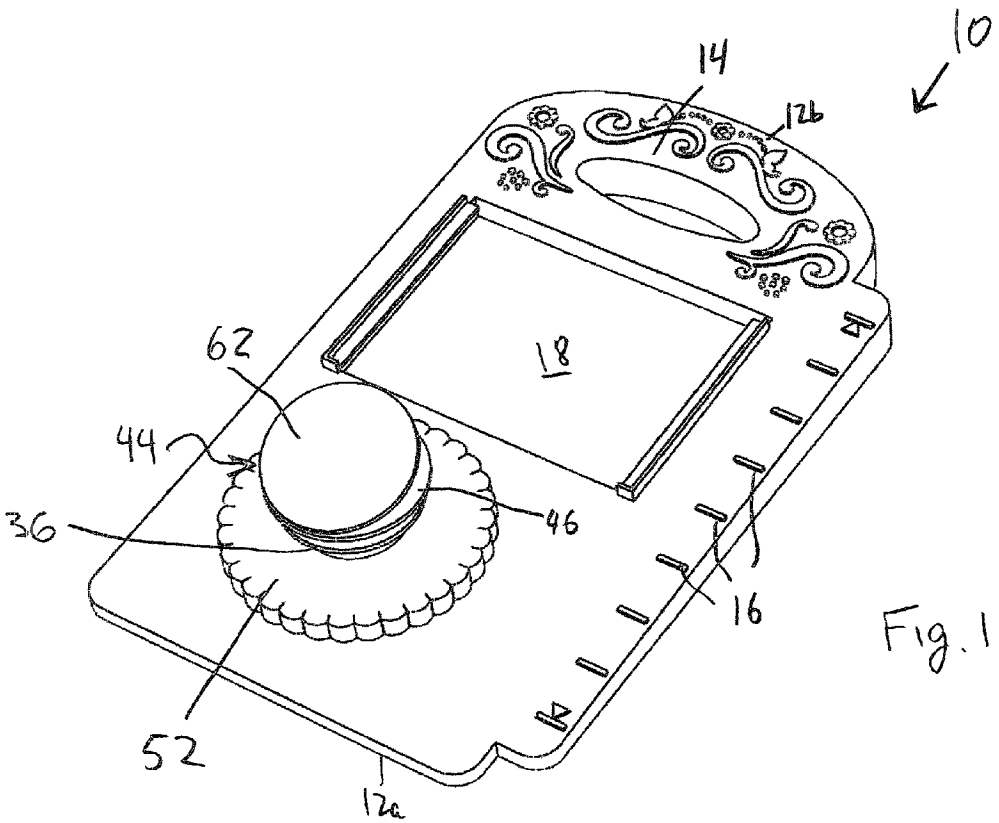
FIG. 1 is a perspective view of a first embodiment of a weaving apparatus in accordance with the invention.
Figure 2:
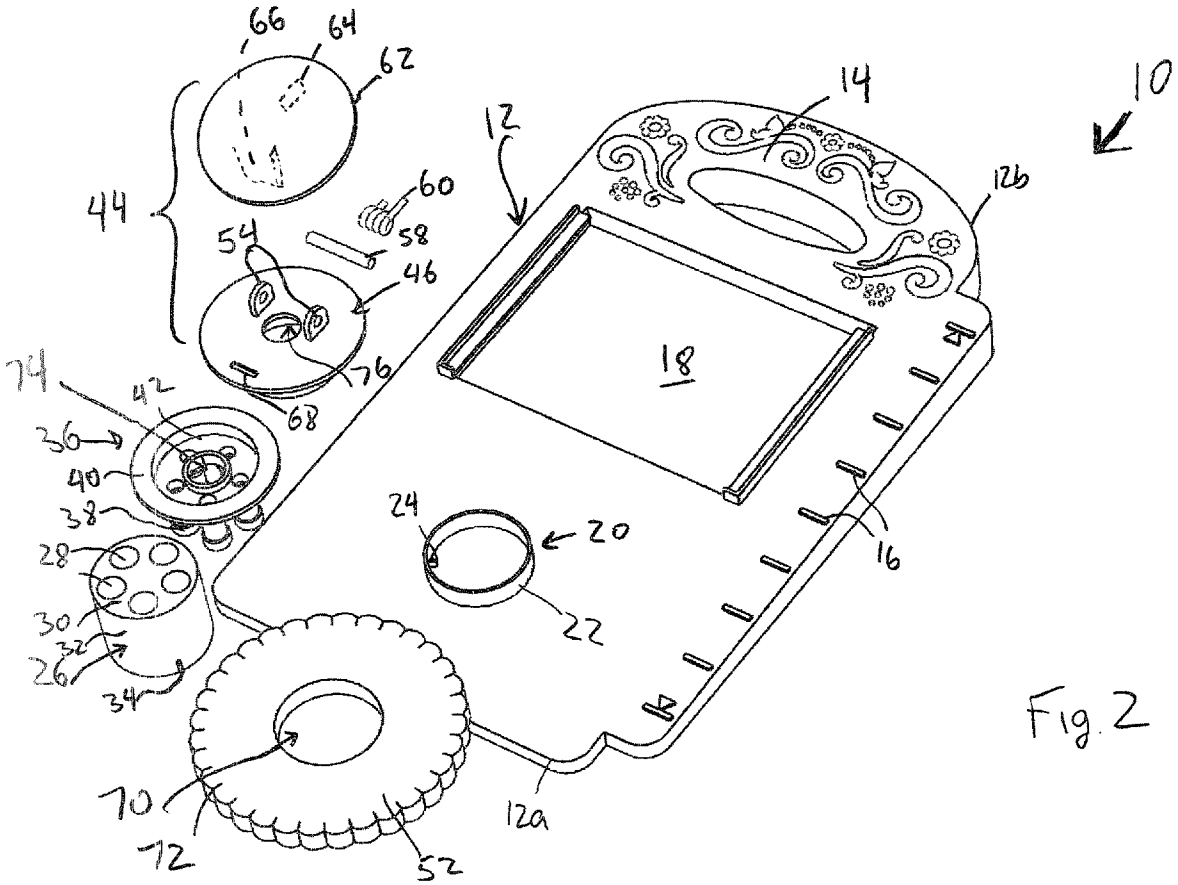
FIG. 2 is an exploded perspective view of the first embodiment of a weaving apparatus shown in FIG. 1.
Figure 4:
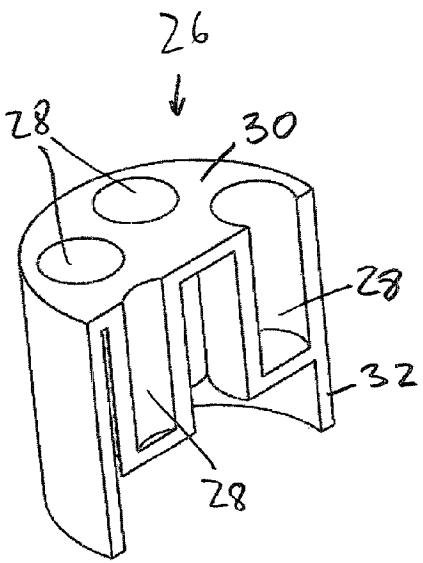
FIG. 4 is a cross-sectional view of the support component shown in FIG. 3 taken along the line 4-4 in FIG. 3.
Figure 3:
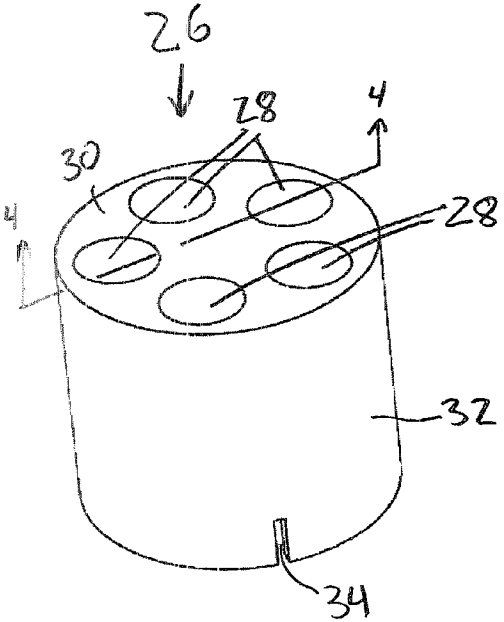
FIG. 3 is a perspective view of a support component of the weaving apparatus shown in FIG. 1.
Figure 6:
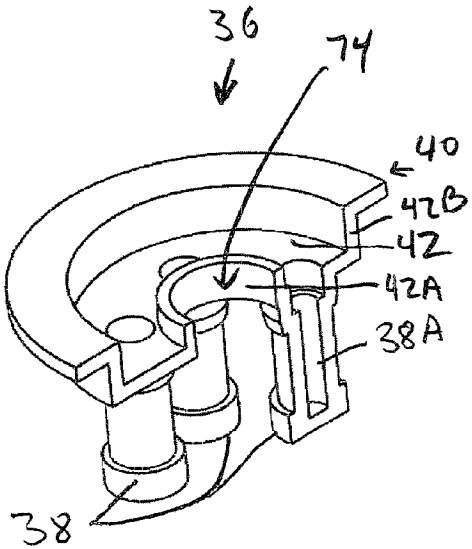
FIG. 6 is a cross-sectional view of the first insert shown in FIG. 5 taken along the line 6-6 in FIG. 5.
Figure 5:
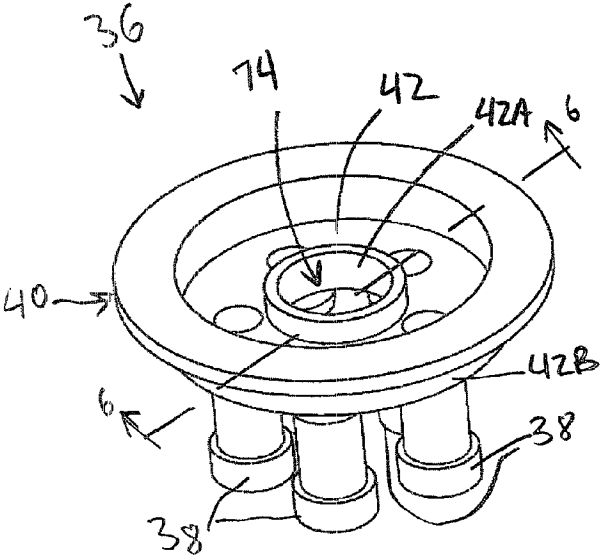
FIG. 5 is a perspective view of a first insert of the weaving apparatus shown in FIG. 1.
Figure 8:
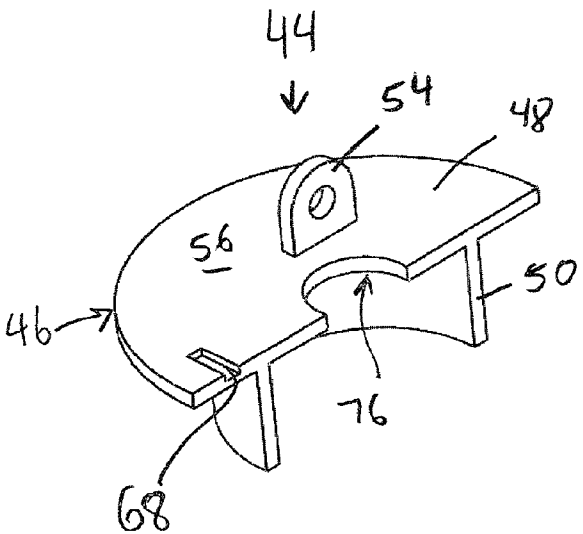
FIG. 8 is a cross-sectional view of the base of the second insert shown in FIG. 7 taken along the line 8-8 in FIG. 7.
Figure 7:
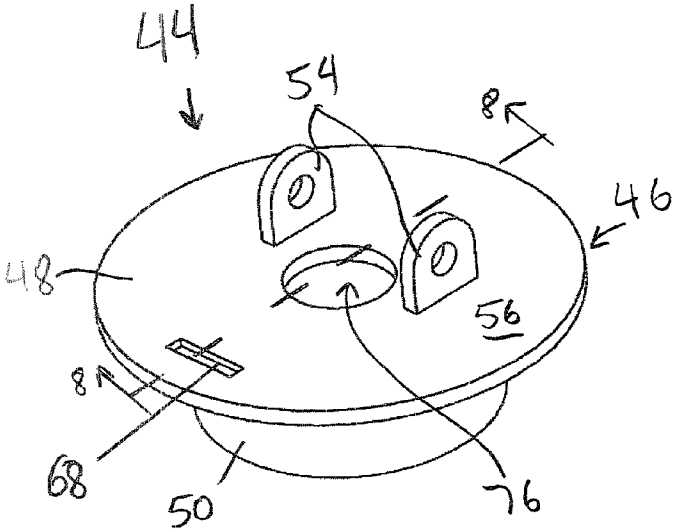
FIG. 7 is a perspective view of a base portion of a second insert of the weaving apparatus shown in FIG. 1.

Referring first to FIGS. 1-10 wherein the same reference numbers refer to the same or similar elements, FIGS. 1 and 2 illustrate an apparatus 10 in accordance with the invention which comprises a generally rectangular base 12 having a handle portion 14. The base 12 is preferably designed so that it can lie flat against a horizontal surface, e.g., it may be provided with a substantially planar lower surface, so that the apparatus can be positioned on a horizontal surface and used in this position.

The shape of the base 12 and the position of the handle portion 14 on the base 12 are not important to the invention and other frame shapes and handle portion positions may be used in the invention. As shown though, handle portion 14 is arranged at one end of the longer side of the base 12 and is surrounded by optional decorative designs.

Along one of the longer sides, a series of optional markings 16 is provided, which may be used, for example, to enable the user to measure the length of a woven structure being formed using the apparatus 10.

The base 12 also includes a receptacle 18 in which threads used with the weaving apparatus 10 may be placed. Receptacle 18 may have a different size and shape than shown in FIGS. 1 and 2, and may be used for storing materials other than threads. Multiple receptacles 18 may be provided.

The base 12 may be provided with a slight inclination from a bottom edge 12*a* to a top edge 12*b* (note the discernible variation in the thickness of the base 12 visible alongside the markings 16). As such, the base 12 has a variable width increasing from the bottom edge to the top edge. An advantage of the inclination of the base 12 is that it becomes easier for the user to perform the weaving using the apparatus 10. Different degrees of inclination of the base 12 may be provided, as desired by the manufacturer.

A retaining structure, or retaining means, 20 is arranged on the upper surface of the base 12. The retaining structure 20 may comprise an annular wall 22, e.g., a circular wall, and includes an inwardly projecting positioning projection 24 on an inner side thereof (see FIG. 2). This location of the positioning projection 24 on the inner side of the annular wall is not limiting and other locations for one or more positioning projections 24 are considered to be within the scope of invention. For example, the positioning projection 24 may project from the upper surface of the base 12 and be separated or slightly distanced from the inner surface of the annular wall 22. Alternative retaining means may be used in the invention.

Annular wall 22 and positioning projection 24 are designed to fittingly engage and removably retain a support component or portion 26 that supports other structure used for weaving. Support portion 26, seen best in FIGS. 3, 4 and 9A, defines a plurality of cavities 28 extending in a direction downward from its upper surface 30, the purpose of which is explained below. Support portion 26 also includes an annular wall 32 extending downward, i.e., in the same direction as the cavities 28 extend, from a peripheral edge of the upper surface 30. Annular wall 32 may be tubular with a circular cross-section when the annular wall 22 also has a circular cross-section. A slit 34 is formed extending upward from a lower edge of the annular wall 32 and is designed to engage with the positioning projection 24 on the annular wall 22 when the support portion 26 is placed into engagement with the annular wall 22. This may be achieved by rotating the support portion 26 until the slit 34 aligns with the positioning projection 24 and then pushing the supporting portion 26 against the upper surface of the base 12 within the area bound by the annular wall 22.

Figure 10:
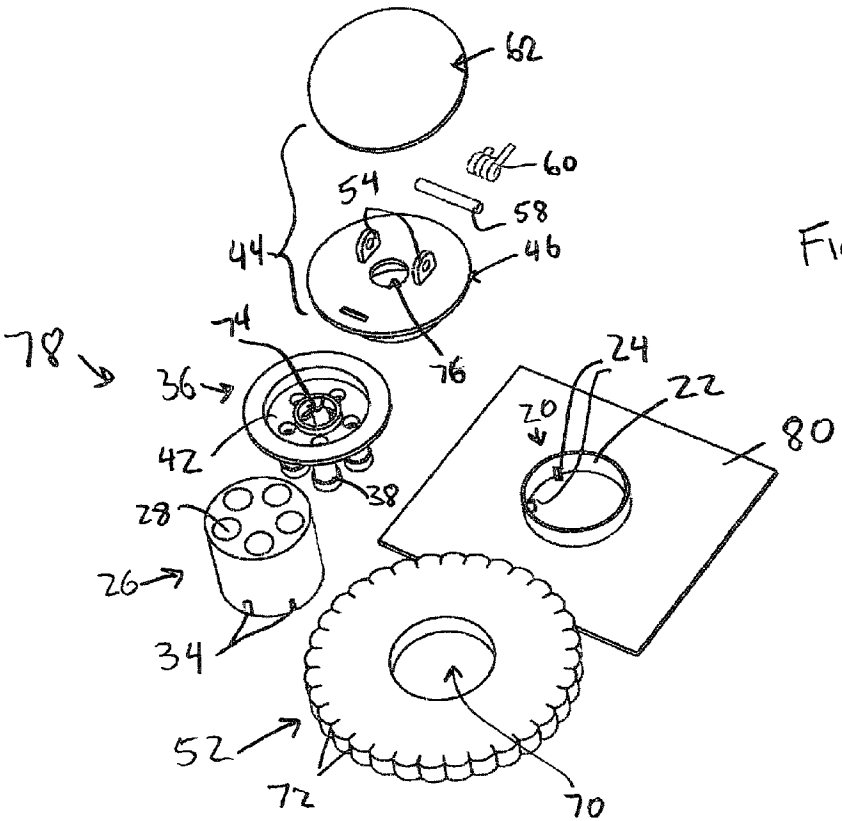
FIG. 10 is an exploded perspective view of a second embodiment of a weaving apparatus in accordance with the invention.

Although the embodiment illustrated in FIG. 1 includes a single positioning projection 24 and a corresponding singular slit 34, a plurality of positioning projections 24 may be formed on the inner surface of the annular wall 22 along with a corresponding number of slits 34 on the annular wall 32 (as shown, for example, in the embodiment shown in FIG. 10).

Instead of annular walls 22, 32 on the base 12 and support portion 26, respectively, and a cooperating engagement or securing mechanism formed by a positioning projection 24 on the annular wall 22 and a corresponding slit on annular wall 32, other engagement, mating, connecting, securing, fastening or coupling mechanisms or means may be used in the invention without deviating from the scope and spirit thereof and are contemplated as being part of the invention.

Generally, support portion 26 forms a base for engaging with and holding or securing retaining projections of an insert.

In this regard, referring now to FIGS. 5, 6, 9B and 9C a first insert 36 is configured to engage and/or mate with the support portion 26. Specifically, the first insert 36 includes a number of projections 38 projecting downward from a lower surface of an upper portion 40, sometimes referred to herein as descending projections, which have a size enabling them to fit in the cavities 28. The number of descending projections 38 may be the same as the number of cavities 28, but may also be less. Also, the projections 38 preferably have the same shape and size.

In addition to the descending projections 38 projecting therefrom, the upper portion 40 defines an annular channel or receptacle 42, bound on an inner side by a small tubular wall 42A and bound on an outer side by a tubular wall 42B. Upper portion 40 has a substantially planar upper surface, aside from the receptacle 42. The descending projections 38 including interior channels 38A that open into the receptacle 42 (see FIG. 6). The upper portion 40 and the receptacle 42 therein may be substantially circular in cross-section as shown, which shape is used in other components of the apparatus 10, such as the support portion 26 described above, but does not limit the apparatus or any of its components.

Referring now to FIGS. 7, 8, 9D, 9E, 9F and 9G, a second insert 44 is configured to engage and/or mate with the first insert 36, and more specifically, to engage and/or mate with the receptacle 42 on the upper portion 40 of the first insert 36. To this end, the second insert 44 includes a base 46 which has an upper, support portion 48 and a descending portion 50 projecting downward from the upper portion 48 and that has substantially the same outer peripheral or circumferential shape as the receptacle 42. Descending portion 50 may thus be a projection or an annular wall having a circular cross-section and whose outer periphery is dimensioned to abut with a small or no clearance against the peripheral wall of the upper portion 40 that defines the receptacle 42. The height of the descending portion 50, in combination with the depth of the receptacle 42, is designed to provide a sufficient height to enable a weaving platform 52, discussed below, to be placed between the upper portion 48 of the base 46 of the second insert 44 and the upper portion 40 of the first insert 36.

Instead of providing the second insert 44 with the descending portion 50 and the first insert 36 with the receptable 42, it is possible to provide the first and second inserts 36, 44 with other cooperating engagement portions, including those known to persons skilled in the art. Regardless of the type of cooperating engagement portions used, the engagement portions should create a space between parts of the first and second inserts 36, 44, into which space, the weaving platform 52 will fit while the second insert 44 is supported by the first insert 36.

Second insert 44 also includes a pair of mounting projections 54 on the upper surface 56 of the upper portion 48 of the base 46, which may be separate from and attached to the second insert 44 or formed integral therewith. Mounting projections 54 accommodate a shaft or pin 58 around which a spring 60 is placed (see FIGS. 2, 9E and 9F). The second insert 44 also includes a flap 62 that includes an optional recess 64 on its underside into which part of the spring 60 is placed, and a support wall 66 that provides the flap 62 with a stable position on the base 46 (the recess 64 and support wall 66 being shown in dotted lines in FIG. 2). Mounting projections 54A are optionally provided on the underside of the flap 62 to secure the spring 58 see FIG. 9G).

Support wall 66 constitutes part of a holding or securing mechanism that, during use of the apparatus, holds or secures one or more threads or a knot formed therefrom by pressing it against the upper surface 56 of the upper portion 48 of the base 46. To aid in this pressing, an indentation 68 may be formed in the upper surface 56 of the upper portion 48 of the base 46 in alignment with the support wall 66 (see FIGS. 7 and 8). The holding/securing mechanism or holding/securing means would also include the structure that mounts and biases the flap 62 against the base 46. Other holding or securing means for holding or securing threads to be woven using the apparatus may be provided, instead of the biased flap 62 cooperating with the second insert 44.

Figures 9A, 9B, 9C, 9D, 9E, 9F, 9G, 9H:
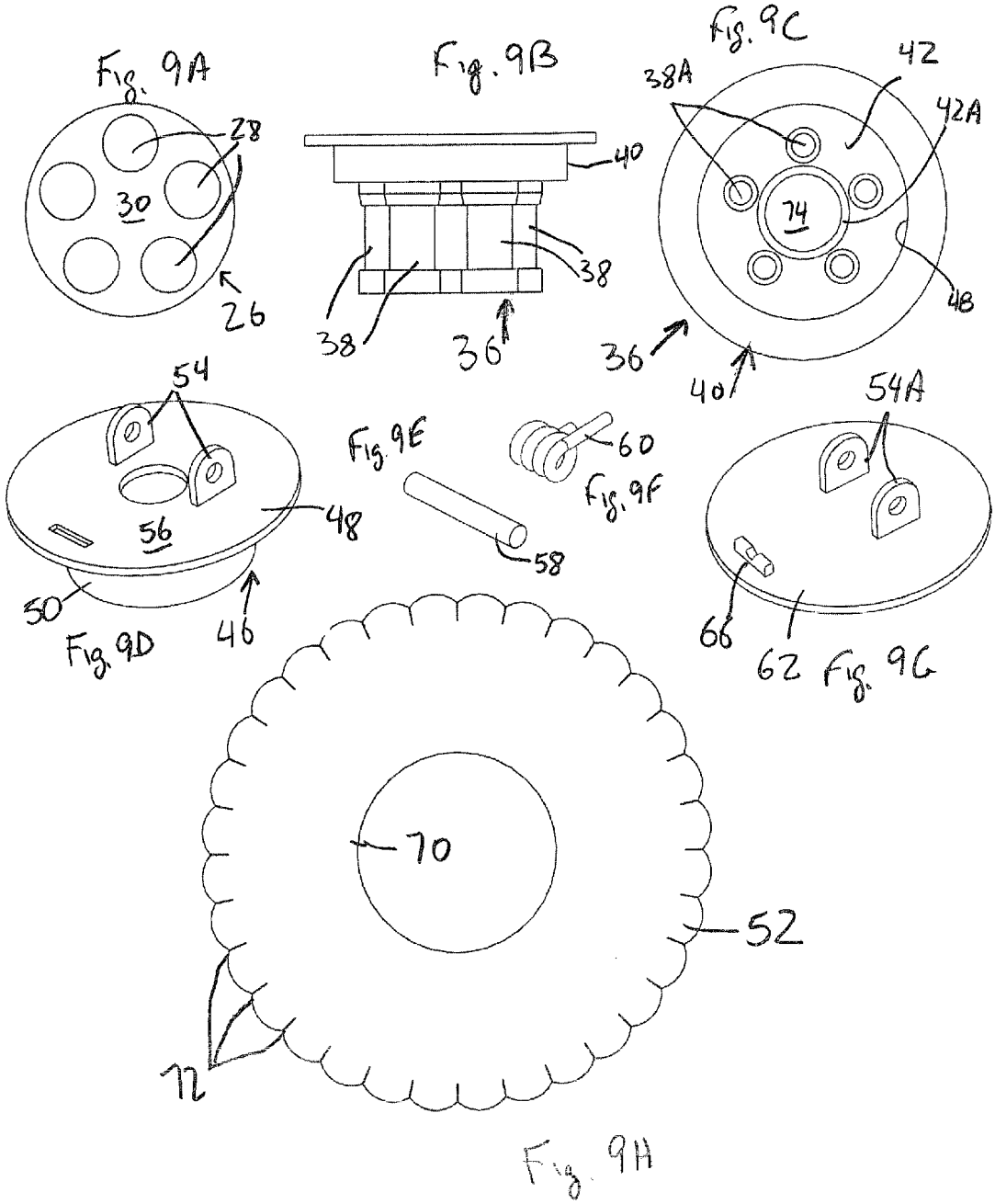
FIGS. 9A-9H shows various parts of the weaving apparatus in accordance with the invention.

The weaving platform 52 is shown in FIGS. 1, 2 and 9H and includes an aperture 70 in a central region to enable it to be placed between the upper portion 40 of the first insert 36 and the upper portion 48 of the base 46 of the second insert 44, and thus secured between the first and second inserts 36, 44.

Aperture 70 may have the same shape as the descending portion 50 of the second insert 44, e.g., circular as shown.

Weaving platform 52 includes slits 72 along its circumference and has generally circular shape. Slits 72 may be numbered or otherwise designated to enable a user to be guided as to the manner in which to form a friendship bracelet or other woven structure using the apparatus 10.

A storage bag or other type of storage housing may be provided to house the base 12, the first and second inserts 36, 44 and the weaving platform 52 for easy carrying during travel.

To assemble the apparatus 10 for use, in one exemplifying, non-limiting manner of use, the support portion 26 is engaged with the base 12 by aligning the slit 34 with the positioning projection 24 and then pushing the support portion 26 against the upper surface of the base 12 within the area bound by the annular wall 22. The weaving platform 52 is placed onto the descending portion 50 of the second insert 44 by passing the descending portion 50 through the aperture 70 in the weaving platform 52. The first insert 36 is then engaged with the second insert 44 by positioning the descending portion 50 of the second insert 44 into the receptacle 42 in the upper portion 40 of the first insert 36, thereby sandwiching the weaving platform 52 between the first and second inserts 36, 44. Other assembly between the first and second inserts 36, 44. Other assembly and second inserts 36, 44 are also contemplated as being within the scope and spirit of the invention.

The first insert 36 is then positioned on the support portion 26 of the base 12 by inserting the projections 38 on the first insert 36 into corresponding cavities 28 in the support portion 26. The apparatus 10 is now ready for use to form a friendship bracelet, or other woven structure.

As an alternative assembly method, the first insert 36 may initially be placed into engagement with the support portion 26 of the base 12 and then the assembly of the weaving platform 52 and second insert 44 placed thereon.

As another alternative assembly method, the first insert 36 may initially be placed into engagement with the support portion 26 of the base 12, then the weaving platform 52 placed onto the first insert 36 and then the second insert 44 placed through the aperture 70 of the weaving platform 52 into engagement with the first insert 36 (while adjusting the weaving platform 52 to enable alignment of the descending portion 50 of the second insert 44 into the receptacle 42 of the first insert 36, if necessary).

Further, the first and second inserts 36, 44 includes central apertures 74, 76, respectively, which align with the aperture 72 in the weaving platform 52. The aligning apertures 72, 74, 76 may be used to pass a woven structure therethrough during use of the apparatus 10.

There are numerous different ways to use the apparatus 10 to form a friendship bracelet, which is an example of a woven structure that may be formed using the apparatus in accordance with the invention. The apparatus is not limited to use to form or weave a friendship bracelet and its use to form other woven structures is considered part of the invention.

One way to use the apparatus 10 to form a friendship bracelet, which involves forming a simple diagonal bracelet, requires the user to obtain four, same-sized, possibly different colored threads. The four threads are lined up alongside one another, and a knot is formed about 0.5 inches from the end of the threads. The knot is clipped into the apparatus 10 to secure the threads. This may entail lifting the flap 62 against the bias of the spring 60 and then placing the knot under or behind the support wall 66 so that the when the flap-lifting force is removed, the spring 60 is biased to cause the support wall 66 of the flap 62 to press the threads and/or knot against the upper surface 56 of the second insert 44.

The four threads are then placed into four sequential slits 72. By alternatingly lifting two different threads from their slits 72 and placing one under or above the other and/or looping them, which steps are well known to those skilled in the art of making friendship bracelets, knots are formed in the threads. Continual looping and knot formation results in the formation of a woven structure with a knot at one end. The woven structure is then removed from the apparatus 10 by lifting the flap 62 and then the free ends of the threads are tied together to prevent the knots from untwisting.

Other weaving techniques may also be used with the apparatus including techniques to form a cobra bracelet, twisted cobra bracelet, and barrel braided bracelet. Some of these techniques involve rotation of the weaving platform 52. Weaving platform 52 is able to be rotated by lifting it up relative to the first insert 36 and re-positioning it in a different position on the first insert 36.

FIG. 10 shows a variation of the apparatus 10, this apparatus being designated 78. Apparatus 78 includes a base 80 which is in the form of a planar sheet having a substantially rectangular shape and substantially planar upper and lower surfaces. Base 80 may be provided with other geometric forms. Base 80 has a small thickness, lightweight and therefore is easily portable. Apparatus 78 includes the support portion 26, first and second inserts 36, 44 and weaving platform 52 as described above.

Also, differing from the embodiment illustrated in FIG. 1, it includes two positioning projections 24 formed on the inner surface of the annular wall 22 of the retaining structure 20 and thus two corresponding slits 34 on the annular wall 32 of the support portion 26. The positioning projections 24 are spaced the same angular distance apart from one another as the slits 34 are.

In other respects, the components and manner of use of apparatus 78 is the same as that for apparatus 10.

Referring now to FIGS. 11-17 wherein the same reference numbers refer to the same or similar elements, another embodiment of a weaving apparatus 110 in accordance with the invention comprises a generally heart-shaped frame 112 having a handle 114. The shape of the frame 112 and the position of the handle 114 on the frame 112 are not important to the invention and other frame shapes and handle positions may be used in the invention.

Figure 11:
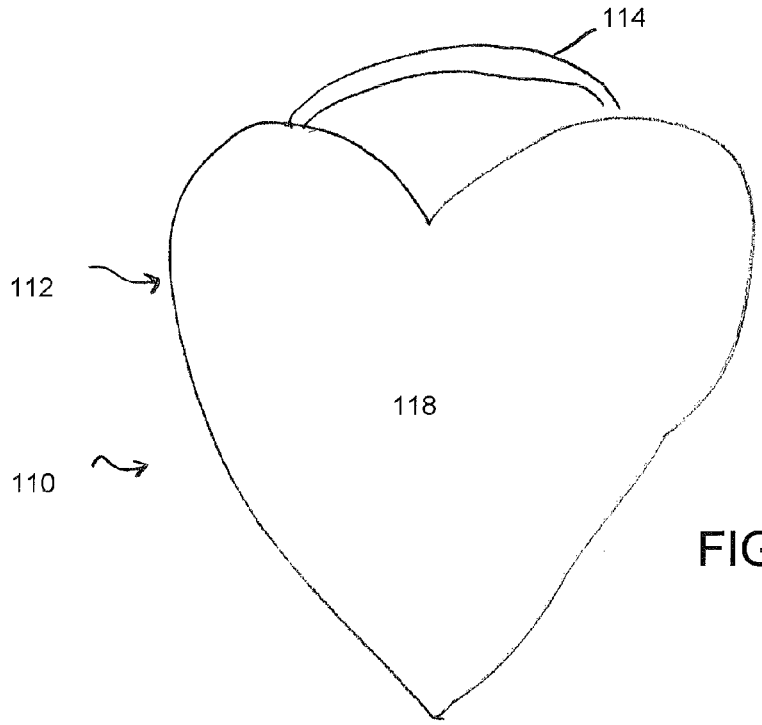
FIG. 11 is a top view of a third embodiment of a weaving apparatus in accordance with the invention.
Figure 12:
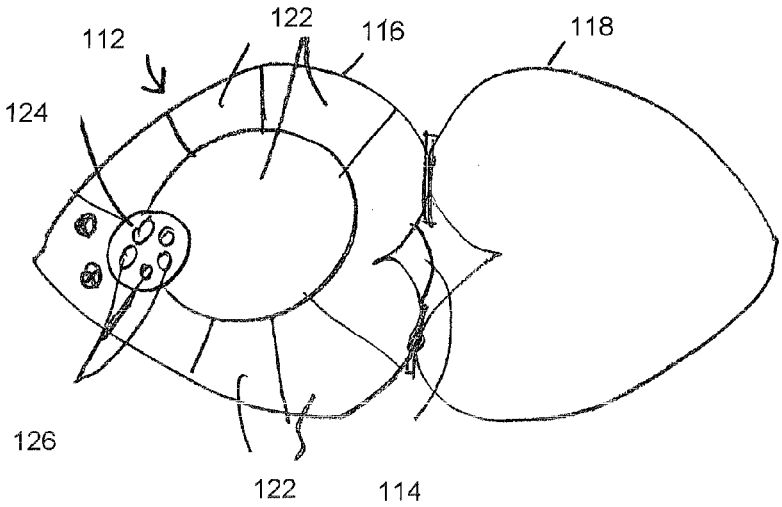
FIG. 12 is a top view of the apparatus shown in FIG. 11 with a cover opened to expose a base.

Frame 112 has a base 116 and a cover 118 that is attached to the base 116 to provide the frame 112 with a closed configuration shown in FIG. 11 and an open configuration shown in FIG. 12. This attachment may be provided by hinges 120, or any other suitable attachment mechanism. Part of each hinge 120 is arranged on the base 116 and another part is arranged on the cover 118. Although the hinges 120 provide the cover 118 with pivotal movement relative to the base 116, other types of movement are possible, involving only partial or complete separation of the cover 118 from the base 116.

Base 116 is provided with a plurality of compartments 122, that may be used to retain the insert, described below, threads or any other objects whether necessary for the practice of the invention or otherwise. The number and shape of the compartments 122 is not important to the invention, and only a single compartment 122 may be provided in the interior of the frame 112. Further, the compartments 122 are covered by the cover 118 when the cover 118 is in its closed configuration and accessible when the cover 118 is in its open configuration.

Frame 112 also includes a support portion 124 similar to defining a plurality of apertures 126, the purpose of which is explained below. Support portion 124 may be formed as a separate component from the base 116 and then attached thereto, e.g., by screws. Alternatively, support portion 124 may be formed integral with the base 116. Generally, support portion 124 forms a base for engaging with and securing retaining projections of an insert. Instead of apertures and cooperating projections, other engagement, mating, connecting or coupling mechanisms may be used in the invention without deviating from the scope and spirit thereof and are contemplated as being part of the invention.

Referring now to FIGS. 13 and 14, a first insert 128 is configured to engage and/or mate with the support portion 124. Specifically, the first insert 128 includes a number of projections 130 projecting downward from a lower surface of an upper portion 132, generally referred to as descending projections, which have a size enabling them to fit in the apertures 126. The number of descending projections 130 may be the same as the number of apertures 126, but may also be less. Also, the projections 130 preferably have the same shape and size.

In addition to the descending projections 130 projecting therefrom, the upper portion 132 defines a receptacle 134. Upper portion 132 has a substantially planar upper surface, aside from the receptacle 134. The upper portion 132 and the receptacle 134 therein may be provided with an ornamental shape as shown, which shape is used in other components of the apparatus 110, but does not limit the apparatus or any of its components.

Referring now to FIGS. 15 and 16, a second insert 136 is configured to engage and/or mate with the first insert 128, and more specifically, to engage and/or mate with the receptacle 134 on the upper portion 132 of the first insert 126. To this end, the second insert 136 includes a base 138 which has an upper, support portion 140 and a descending portion 142 projecting downward from the upper portion 140 and that has substantially the same outer peripheral or circumferential shape as the receptacle 134. Descending portion 142 may be an annular wall whose outer periphery is dimensioned to abut with a small or no clearance against the peripheral wall of the upper portion 132 that defines the receptacle 134. The height of the descending portion 142, in combination with the depth of the receptacle 134, is designed to provide a sufficient height to enable a weaving platform 156, discussed below, to be placed between the upper portion 140 of the base 138 of the second insert 136 and the upper portion 132 of the first insert 128.

Second insert 136 also includes a pair of mounting projections 144 on its upper surface 164, which may be separate from and attached to the second insert 136 or formed integral therewith. Mounting projections 144 accommodate a shaft or pin 146 around which a spring 148 is placed (see FIG. 15). The second insert 136 also includes a flap 150 that includes a recess 152 on its underside (FIG. 16 being a bottom view of the flap 150) into which part of the spring 148 is placed, and a support wall 154 that provides the flap 150 with a stable position on the base 138.

Support wall 154 also constitutes part of a securing mechanism that, during use of the apparatus, secures one or more threads or a knot formed therefrom by pressing it against the upper surface 164 of the upper portion 140 of the base 138. To aid in this pressing, an indentation 162 may be formed in the upper surface 164 of the upper portion 140 of the base 138 in alignment with the support wall 154 (see FIG. 15). The securing mechanism or securing means would also include the structure that mounts and biases the flap 150 against the second insert 136. Other securing means for securing threads to be woven using the apparatus may be provided, instead of the biased flap 150 cooperating with the second insert 136.

A weaving platform 156 shown in FIG. 17 includes an aperture 158 in a central region to enable it to be placed between the upper portion 132 of the first insert 128 and the upper portion 140 of the base 138 of the second insert 136, and thus secured between the first and second inserts 128, 136. Aperture 158 may have the same shape as the descending portion 142 of the second insert 136.

Weaving platform 156 includes slits 160 along its circumference and has generally circular shape. Slits 160 may be numbered or otherwise designated to enable a user to be guided as to the manner in which to form a friendship bracelet or other woven structure using the apparatus 110.

The first and second inserts 128, 136 and the weaving platform 156 may be stored in one or more of the compartments 122 in the base 116 when the apparatus 110 is not in use, if these compartments 122 are dimensioned to be of sufficient size to enable such storage. For example, the central, circular compartment 122 in the base 116 may be dimensioned to retain the weaving platform 156 and respective compartments outward of the central compartment may be dimensioned to retain the first insert 128 and the second insert 136. If not, a kit may be provided including the frame 112, the first and second inserts 128, 136 and the weaving platform 156 and include a separate housing (not shown).

When not in use, the cover 118 is pivoted from the open position shown in FIG. 12 to the closed position shown in FIG. 11 covering the compartments 122 and materials and/or components therein, and a latching mechanism (not shown) is engaged to maintain the cover 118 in engagement with the base 116 over the compartments 122.

To assemble the apparatus 110 for use, in one exemplifying, non-limiting manner of use, the cover 118 is pivoted to its open position and the inserts 128, 136 and weaving platform 156, if retained in the compartments 122 in the base 112 are removed. The weaving platform 156 is placed onto the descending portion 142 of the second insert 136 by passing the descending portion through the aperture 158 in the weaving platform 156. The first insert 128 is then engaged with the second insert 136 by positioning the descending portion 142 of the second insert 136 into the receptacle 134. In the upper portion 132 of the first insert 128, thereby sandwiching the weaving platform 156 between the first and second inserts 128, 136. Other assembly methods to sandwich the weaving platform 156 between the first and second inserts 128, 136 are also contemplated as being within the scope and spirit of the invention.

The first insert 128 is then positioned on the support portion 124 of the frame 112 by inserting the projections 130 on the first insert 128 into corresponding apertures 126 in the support portion 124. The apparatus 110 is now ready for use to form a friendship bracelet, or other woven structure.

As an alternative assembly method, the first insert 128 may initially be placed into engagement with the support portion 124 of the frame 112 and then the assembly of the weaving platform 156 and second insert 136 placed thereon.

As another alternative assembly method, the first insert 128 may initially be placed into engagement with the support portion 124 of the frame 112, then the weaving platform 156 placed onto the first insert 128 and then the second insert 136 placed through the aperture 158 of the weaving platform 156 into engagement with the first insert 128 (while adjusting the weaving platform 156 to enable alignment of the descending portion 142 of the second insert 136 into the receptacle 134 of the first insert 128).

There are numerous different ways to use the apparatus 110 to form a friendship bracelet, which is an example of a woven structure that may be formed using the apparatus in accordance with the invention. The apparatus is not limited to use to form or weave a friendship bracelet and its use to form other woven structures is considered part of the invention.

One way to use the apparatus 110 to form a friendship bracelet, which involves forming a simple diagonal bracelet, requires the user to obtain four, same-sized, possibly different colored threads. The four threads are lined up alongside one another, and a knot is formed about 0.5 inches from the end of the threads. The knot is clipped into the apparatus 110 to secure the threads. This may entail lifting the flap 150 against the bias of the spring 148 and then placing the knot under or behind the support wall 154 so that the when the flap-lifting force is removed, the spring 148 is biased to cause the support wall 154 of the flap 150 to press the threads and/or knot against the upper surface 164 of the second insert 136.

The four threads are then placed into four sequential slits 160. By alternatingly lifting two different threads from their slits 160 and placing one under or above the other and/or looping them, which steps are well known to those skilled in the art of making friendship bracelets, knots are formed in the threads. Continual looping and knot formation results in the formation of a woven structure with a knot at one end. The woven structure is then removed from the apparatus 110 by lifting the flap 150 and then the free ends of the threads are tied together to prevent the knots from untwisting.

All of the components of the apparatus 10, 78, 110 may be formed from plastic or another suitable material, details of which would be readily ascertainable to one skilled in the art without undue or unreasonable experimentation. Further, the formation of such plastic parts for the invention may be made using any plastic manufacturing techniques known to those skilled in the art.

Having described exemplary embodiments of the invention with reference to the accompanying drawings, it will be appreciated that the present invention is not limited to those embodiments, and that various changes and modifications can be effected therein by one of ordinary skill in the art without departing from the scope or spirit of the invention as defined by the appended claims.

The invention claimed is:

1. A weaving apparatus for use in weaving threads into a woven structure, comprising:

a support portion;

a first insert that engages with said support portion and defines a receptacle;

a second insert including a base having a projection and being positionable in engagement with said first insert by positioning said projection at least partly into said receptacle of said first insert, said second insert further including securing means for securing threads to be woven using the apparatus; and a weaving platform positionable between said first and second inserts and around at least part of said projection of said second insert, said weaving platform including slits around its circumference adapted to secure threads.

2. The apparatus of claim 1, further comprising a base including a retaining structure, said support portion removably engaging with said retaining structure.

3. The apparatus of claim 2, further comprising cooperating securing means for removably securing said support portion to said retaining structure.

4. The apparatus of claim 2, wherein said retaining structure comprises a wall including at least one positioning projection.

5. The apparatus of claim 4, wherein said support portion comprises a wall including a number of slits corresponding to the number of said at least one positioning projection and each of which is adapted to engage with a respective one of said at least one positioning projection when said support portion is engaged with said retaining structure.

6. The apparatus of claim 5, wherein said at least one positioning projection comprises a plurality of positioning projections and said wall includes a corresponding number of slits, an angular spacing between said positioning projections and said slits being the same.

7. The apparatus of claim 1, wherein said support portion defines a plurality of cavities, said first insert including a corresponding number of projections that enter into said cavities of said support portion to thereby provide engagement of said first insert to said support portion.

8. The apparatus of claim 7, wherein said receptacle in said first insert is in the form of an annular channel, said projections on said first insert including interior channels opening into said annular channel.

9. The apparatus of claim 1, wherein said securing means comprise a pair of mounting projections extending from an upper portion of said second insert, a shaft or pin arranged on said mounting projections, a spring placed around said shaft or pin and a flap biased by said spring against another part of said second insert.

10. The apparatus of claim 9, wherein said flap comprises a wall extending downward to a biased position against said support portion.

11. The apparatus of claim 1, further comprising:

a frame including:

a base including an interior;

a cover movable relative to said base to provide said frame with a closed configuration covering said interior of said base and an open configuration in which said interior of said base is accessible.

12. The apparatus of claim 11, further comprising a handle attached to said frame.

13. The apparatus of claim 11, further comprising an attachment mechanism for movably attaching said cover to said base.

14. The apparatus of claim 11, wherein said base defines a plurality of separate compartments in said interior receivable of said first and second inserts and said weaving platform.

15. The apparatus of claim 1, wherein said first insert includes an upper portion defining said receptacle, said base of said second insert has an upper portion, and said projection comprises a wall projecting from a lower surface of said upper portion of said base, said second insert being positionable in engagement with said first insert by positioning said wall into said receptacle of said first insert, said weaving platform being positionable around at least part of said wall.

16. A weaving apparatus for use in weaving threads into a woven structure comprising:

a base;

a weaving platform;

a support portion for supporting said weaving platform on said base;

retaining means arranged on said base for removably retaining said support portion;

a first insert that engages with said support portion and has a first cooperating engagement portion;

a second insert having a second cooperating engagement portion that engages with said first cooperating engagement portion to provide engagement between said first and second inserts; and securing means arranged on said second insert for securing threads to be woven using the apparatus, said weaving platform being positionable between said first and second inserts and including slits around its circumference adapted to secure threads.

17. The apparatus of claim 16, wherein said retaining means comprise a wall including at least one positioning projection, said support portion comprising a wall including a number of slits corresponding to the number of said at least one positioning projection and each of which is adapted to engage a respective one of said at least one positioning projection when said support portion is engaged with said retaining structure.

18. The apparatus of claim 17, wherein said at least one positioning projection comprises a plurality of positioning projections and said wall includes a corresponding number of slits, an angular spacing between said positioning projections and said slits being the same.

19. A weaving apparatus for use in weaving threads into a woven structure, comprising:

a frame including:

a base defining at least one compartment;

a cover pivotable relative to said base between a position covering said at least one compartment and a position enabling access to said at least one compartment;

a support portion;

a first insert that engages with said support portion;

a second insert including a base having an upper portion and a wall projecting downward from said upper portion, said second insert being positionable in engagement with said first insert, said second insert further including securing means for securing threads to be woven using the apparatus; and a weaving platform positionable between said first and second inserts and around at least part of said wall of said second insert, said weaving platform including slits around its circumference adapted to secure threads.

20. The apparatus of claim 19, wherein said at least one compartment in said base comprises a plurality of separate compartments, said compartments being receivable of said first and second inserts and said weaving platform.

* * * * *

UNITED STATES PATENT AND TRADEMARK OFFICE

CERTIFICATE OF CORRECTION

PATENT NO. : 8,561,650 B1
APPLICATION NO. : 13/464169
DATED : October 22, 2013
INVENTOR(S) : Roshan Wijerama et al.

It is certified that error appears in the above-identified patent and that said Letters Patent is hereby corrected as shown below:

In the Specifications

Column 1, lines 26-27:
Please replace "a base including retaining structure" with --a base including a retaining structure--.

Column 3, lines 10-11:
Please replace "the annular wall is not limiting" with --the annular wall 22 is not limiting--.

Column 5, line 25:
Please replace "assembly between the first and second inserts 36, 44. Other" with --assembly methods to sandwich the weaving platform 52 between the first--.

Column 8, line 37:
Please replace "the descending portion through the aperture" with --the descending portion 142 through the aperture--.

Signed and Sealed this
Twenty-ninth Day of April, 2014

Michelle K. Lee

Michelle K. Lee
*Deputy Director of the United States Patent and Trademark Office*